US006125903A

United States Patent [19]

Uchida

[11] Patent Number: 6,125,903

[45] Date of Patent: Oct. 3, 2000

[54] ADHESIVE TRANSFER DEVICE

[75] Inventor: Hiromichi Uchida, Tokyo, Japan

[73] Assignee: Toyo Chemical Co., Ltd., Tokyo, Japan

[21] Appl. No.: 09/195,126

[22] Filed: Nov. 18, 1998

Related U.S. Application Data

[63] Continuation-in-part of application No. 09/094,980, Jun. 15, 1998, abandoned.

[51] Int. Cl.[7] ..... B32B 31/00; B43L 19/00

[52] U.S. Cl. ..... 156/540; 156/574; 156/579; 118/257; 400/696

[58] Field of Search ..... 156/579, 577, 156/574, 576, 540; 118/257; 400/248, 696

[56] References Cited

U.S. PATENT DOCUMENTS

| | | | |
|---|---|---|---|
| 5,310,437 | 5/1994 | Tucker | 156/238 |
| 5,310,445 | 5/1994 | Tucker | 156/574 |
| 5,556,469 | 9/1996 | Koyama et al. | 118/257 |
| 5,759,270 | 6/1998 | Lee | 118/257 |
| 5,795,085 | 8/1998 | Yoo | 400/248 |

*Primary Examiner*—Richard Crispino
*Assistant Examiner*—Sue A. Purvis
*Attorney, Agent, or Firm*—Wenderoth, Lind & Ponack, L.L.P.

[57] ABSTRACT

An adhesive transfer device is provided, which can lead a separable paper sheet after adhesive transfer to the outside of its case so that the separable paper sheet is not collected therein, is not consumable but capable of being re-used by renewing a tape roll, and permits the user to transfer the adhesive while watching the end of a transfer member from above with its case in a laid-down state. A tape roll support 6 has a first bevel gear 7, and a second bevel gear 2 meshing with the first, bevel gear and having its axis, crossing the axis of the first bevel gear, has fewer teeth than the first bevel gear, and is formed on one side of a feed roller 8, which is disposed on the extension of the separable paper sheet 4 returning, after transfer of adhesive, from the transfer member into the case. The feed roller pinches and pulls separable sheet after the adhesive transfer in cooperation with a pinch roller in contact with the feed roller surface, thereby leading out the separable paper sheet through an outlet 12, which is provided behind the feed roller and on the extension of the separable paper sheet.

5 Claims, 6 Drawing Sheets

ADHESIVE TRANSFER DEVICE

This is a CIP application of Ser. No. 09/094,980, filed Jun. 15, 1998, now abandoned.

BACKGROUND OF THE INVENTION

1. Field of the Invention

The present invention relates to adhesive transfer devices and, more specifically, which permit the user to transfer adhesive while watching the end of a transfer member from above with its case in a laid-down state, so that the adhesive can be accurately located and transferred to a desired position. Also, the present invention concerns an adhesive transfer device, which is particularly useful and permits smoothly paying off and transferring adhesive with low adhesion, such as correction tape for correcting letters or the lie, marking tape constituted by a colored thin film for emphasizing letters or the like, and further adhesive permitting paper or the like to be repeatedly applied to and separated from a transfer surface.

2. Prior Art

Recently, adhesive transfer devices are provided, which can transfer white correction tape applied to a separable paper sheet or transparent colored marking tape to a transfer surface while the tape is paid off one end of a case. These adhesive transfer devices, unlike conventional correction liquid or marking pens, do not require any drying operation. In addition, these devices permit coating to a uniform thickness. Furthermore, the adhesive once transferred to the transfer surface, can be readily removed without use of any rubber eraser or the like so that is will not contaminate the transfer surface.

Such device for transferring correction tape or marking tape has a commonly called closed loop structure, in which a roll of correction tape or marking tape is accommodated in a case and also separable paper sheet, remaining after transfer of sheet, is taken up on a roller provided in the case and interlocked to the tape roll. Pulling them along a transfer surface with their case held upright thereon uses some transfer devices. Other transfer devices are used by pulling them to the left or right with their case in a laid-down state, so that the user can watch the end of a transfer member from above and accurately locate and transfer adhesive to a desired position.

In the above device for transferring correction tape or marking tape accommodated in a case, however, once the separable paper sheet is broken apart, the tape can no longer be paid off the tape roll, thus disabling the transfer. In addition, when the separable paper sheet is excessively paid off, it is difficult to restore a proper tension state of tape. Furthermore, once the closed loop structure is complicated, it is impossible to renew tape roll after the tape has been used up. Therefore, the device is inevitable consumable, which is undesired in view of the recently increasing resources saving trend.

In the transfer device, which is used by pulling it to the left or right with its case held laid down, the tape guide surface of the transfer member is substantially parallel with a side surface of the case facing the transfer surface, which is a 90 degrees orientation change of a transfer member transfer surface of the transfer device which is used with the case held upright. This means that the adhesive transfer tape paid off the tape roll which is mounted such as to be parallel to the side surfaces of the case, has its tape surface re-orientated by 90 degrees in contact with two guide pins, which are provided at an inlet and an outlet of the transfer member, respectively. This structure provides a great load on the tape, and inevitably makes it difficult to feed and lead the adhesive transfer tape and the separable paper sheet. More specifically, in the transfer device the force necessary for paying off the tape depends on the force of friction between the adhesive to the end of the transfer member and the transfer surface. Such adhesive as correction tape and marking tape has low adhesion and provides low frictional force, so that it is difficult to pay off the tape from the tape roll compared to high adhesion adhesive.

SUMMARY OF THE INVENTION

The present invention has an object of providing an adhesive transfer device, which can be used repeatedly by replacing the adhesive tape instead of discarding it, and permits the user to transfer adhesive while watching the end of a transfer member from above with its in a laid-down state.

DETAIL DESCRIPTION OF THE PREFERRED EMBODIMENTS

Figure 1:
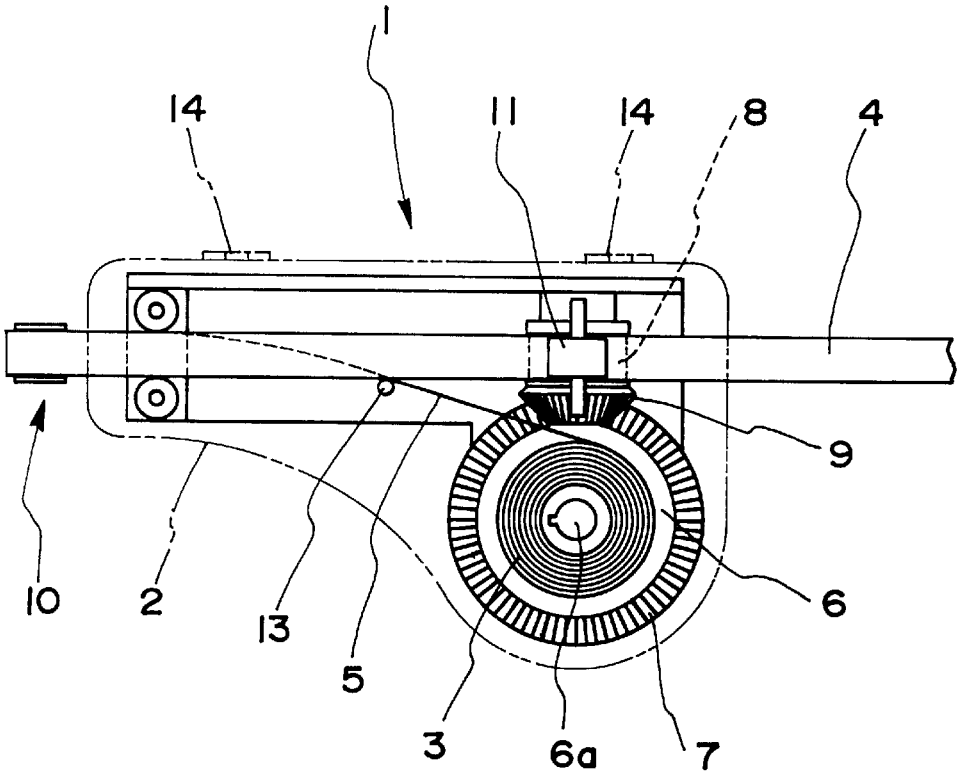
FIG. 1 is a plan view showing a first embodiment of an adhesive transfer device according to the present invention.
Figure 2:
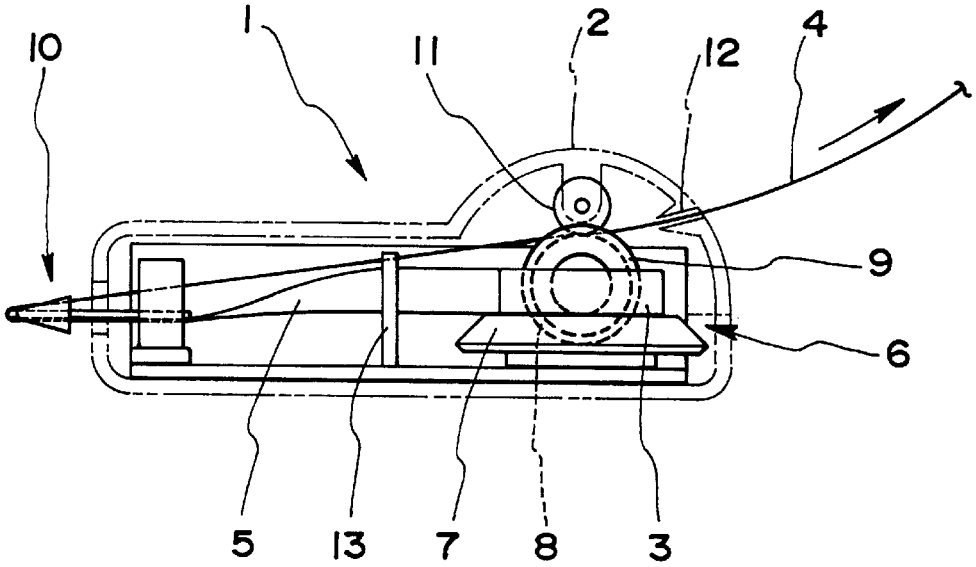
FIG. 2 is a side view showing a first embodiment of an adhesive transfer device according to the present invention.

FIGS. 1 and 2 show a first embodiment of an adhesive transfer device according to the present invention, particularly the internal structure of the device inside a case thereof. Referring to the Figure, reference numeral 1 designates the adhesive transfer device and reference numeral 2 designates a synthetic resin case thereof, which can be held with user's fingers. Reference numeral 3 designates a roll of adhesive transfer tape 5, which includes an adhesive with low adhesion (such as correction tape or marking tape) applied to an elongate separable paper sheet 4 such as to be capable of being transferred. Reference numeral 6 designates a tape roll support, which is rotatably disposed in the case 2 and supports a tape roll 3 detachably secured to it. The tape roll support 6 has a first bevel gear 7 formed on the outer periphery of its lower portion when the case 2 is laid down in use. Reference numeral 8 designates a feed roller having a second bevel gear 9, which meshes with the first bevel gear 7 such that its axis crosses the axis of the first bevel gear 7. Reference numeral 10 designates a beak-like transfer member, through which the adhesive transfer tape 5 paid off the tape roll 3 is led with the adhesive surface outside to the outside of the case 2. With the adhesive surface held pushed against transfer surface of a paper sheet or the like, the adhesive is transferred to the transfer surface by pulling the case 2 in an adhesive transfer direction, i.e., to the right in FIG. 1 in this embodiment. Reference numeral 11 designates a pinch roller provided on the lid of the case 2. In the closed state of the case 2, the pinch roller 11 pinches the separable paper sheet 4 against the feed roller 8 for feeding out the separable paper sheet 4. Reference numeral 12 designates an outlet formed in the case 2 at a position thereof right behind the feed roller 8 and the pinch roller 11. Through the outlet 12, the separable paper sheet 4 after transfer of adhesive is led out to the outside. Reference numeral 13 designates a guide pin that is disposed between the tape roll 3 in the case 2 and the transfer member 10. The guide pin 13 guides the adhesive transfer tape 5 paid off the tape roll 3 to the transfer member 10 by changing the orientation of the adhesive transfer tape 5 by 90 degrees with respect to the tape running direction. The guide pin 13 also guides the separable paper sheet 4 after transfer of adhesive in contact with one edge of the separable paper sheet 4.

The tape roll support 6 and the first bevel gear 7 formed on the outer periphery of the lower portion of the tape roll support 6, are parallel to the bottom of the case 2, i.e., the surface of the case facing the transfer surface. With this structure, the adhesive transfer device 1 can be formed such that it has a shape suitable for transfer operation by pulling it to the right in FIG. 1 with the case 2 laid down, i.e., a thin shape so that it can be held with the thumb and the index finger of the right hand of the user.

The tape roll 3 is a roll of the adhesive transfer tape 5, which includes an adhesive with low adhesion applied to the separable paper sheet 4, which is separable on both sides of it. The tape roll 3 is detachably engaged with a center pin 6*a* of the tape roll support 6 having a support surface parallel to the bottom of the case 2. The case 2 has a hinge 14, and when the entire tape roll 3 has been paid off, the user can make renewal with a new tape roll by opening the case 2.

Figure 5:
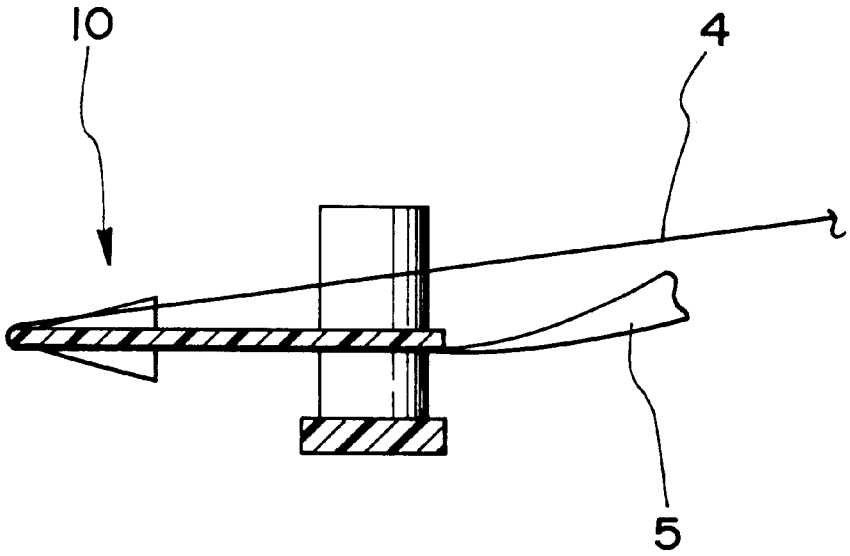
FIG. 5 is a view showing a transfer member and the neighborhood thereof in a first embodiment of the adhesive transfer device according to the present invention.
Figure 6:
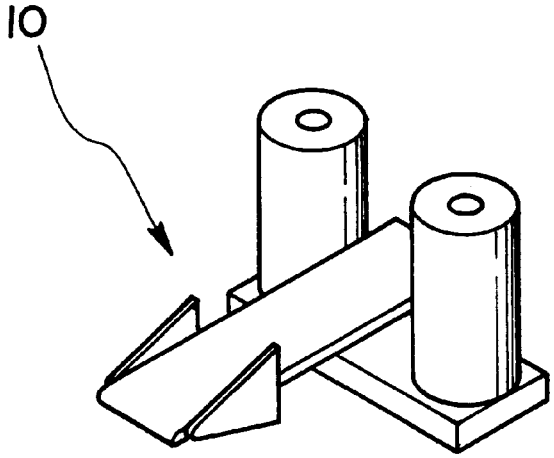
FIG. 6 is a fragmentary perspective view showing the transfer member in a first embodiment of the adhesive transfer device according to the present invention.

The transfer member 10, as shown in FIGS. 5 and 6, serves to lead the adhesive transfer tape 5, paid off the tape roll 3, to the outside of the case 2 for transfer of the adhesive to the transfer surface. The transfer member 10 has guide walls provided on the opposite sides of its end portion, which has substantially the same width as the adhesive transfer tape 5. The transfer member 10 also has a tape guide surface, which is parallel with the bottom of the case 2. As shown in FIG. 5, the adhesive transfer tape 5 paid off the tape roll 3 is guided and positioned by on the lower surface of a guide portion of the transfer member 10, and by pulling the case 2 held with the user's fingers toward the user while pushing the adhesive surface of the adhesive transfer tape 5, led past the end of the transfer member 10, against the transfer surface, the adhesive is transferred thereto, while the separable paper sheet 4 after transfer of adhesive is led round the end of the transfer member 10 and guided along the upper surface of the guide portion of the transfer member 10 into the case 2 again.

Figure 3:
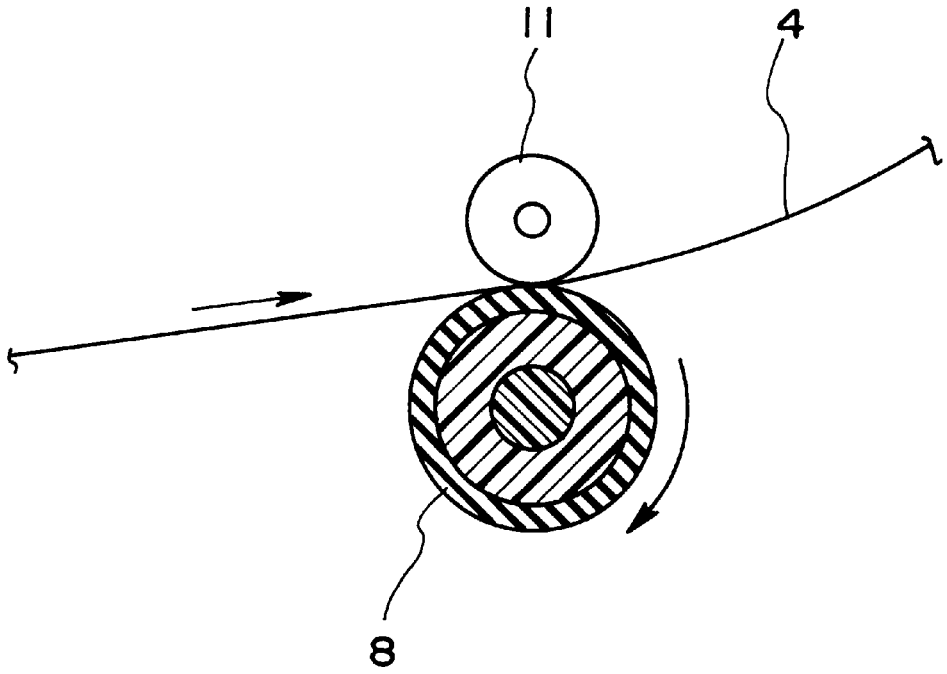
FIG. 3 is a view showing a feed roller and a pinch roller in a first embodiment of the adhesive transfer device according to the present invention.
Figure 4:
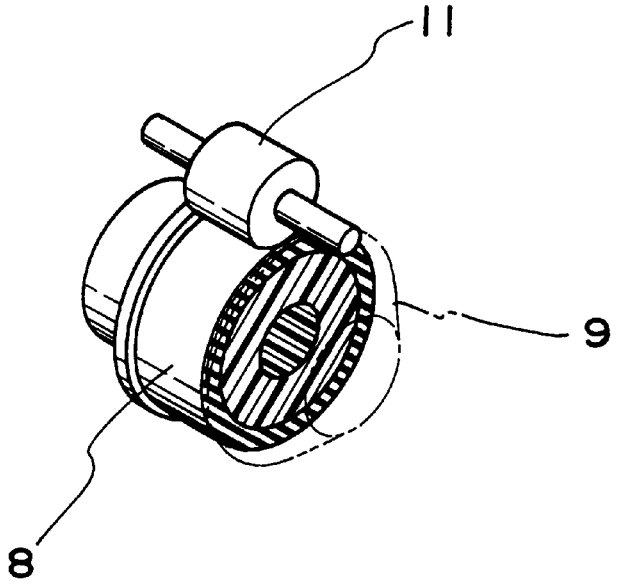
FIG. 4 is a view showing the feed roller and the pinch roller in a first embodiment of the adhesive transfer device according to the present invention.

As shown in FIGS. 3 and 4, the feed roller 8 has flanges provided on the opposite sides of its outer periphery, which flanges serve as guide to prevent the separable paper sheet from being detached. In order to be able to reliably lead out the separable paper sheet, which the feed roller 8 readily slips against, in this embodiment the roller outer periphery, which the separable paper sheet is in contact with, should have high coefficient of friction. In this embodiment, a rubber belt is wound on the roller outer periphery, or the roller outer periphery is formed with a rough surface or roulette like that of a paper file. The pinch roller 11 pinches and pulls the separable paper sheet 4 in cooperation with the pinch roller 11. In the closed state of the case 2, the pinch roller 11 which is provided on the lid of the case 2, pinches the separable paper sheet 4 in cooperation with the feed roller 8, and by opening the case 2 the separable paper sheet 4 is released from the pinched state.

The first bevel gear 7 of the tape roll support 6 and the second bevel gear 9 of the feed roller 8 mesh with each other such that their axes cross each other as shown in FIG. 1. In this embodiment, the teeth ratio between the feed roller 8 and the tape roll support 6 is set such that the rotational speed of the feed roller 8 is higher than that of the tape roll support 6. For example, the feed roller 8 completes about two rotations with one rotation of the tape roll support 6. Of course, the teeth ratio is not limited to 2:1, but can be appropriately set.

A series of adhesive transfer operations of the adhesive transfer device 1 having the above construction according to the first embodiment of the present invention will now be described. First, the end of the transfer member 10 of the adhesive transfer device 1 is held in contact with the transfer surface of a paper sheet or the like at a suitable angle thereto. Then, the adhesive transfer device 1 is pulled in the adhesive transfer direction, i.e., to the right in FIG. 1, while applying an adequate pushing force to it. As a result, the adhesive at the end of the transfer member 10 is pushed against and transferred to the transfer surface, while the adhesive transfer tape 5 between the tape roll support 6 and the transfer member 10 is pulled and paid off. The tape roll support 6 is thus rotated in the counterclockwise direction in FIG. 1, and drives the feed roller 8 for rotation in the clockwise direction in FIG. 2.

The separable paper sheet 4 after transfer of adhesive is pinched between the feed roller 8 and the pinch roller 11, and led out to the outlet 12 provided rearward of these rollers with the rotation of the feed roller 8. As shown in FIG. 2, in its path from the transfer member 10 to the outlet 12, the separable paper sheet 4 proceeds substantially straight without being bent upwardly, downwardly, to the left or to the right or being twisted. The separable paper sheet 4 is merely in contact on one side of it with the guide pin 13, and can be led out smoothly without constituting substantial load with respect to its pulling by the feed roller 8.

The adhesive transfer tape 5 paid off the tape roll 3 and the separable paper sheet 4 led out by the feed roller 8 are of course equal in length. However, owing to the teeth ratio noted above the feed roller 8 is rotated at double the rotational speed of the tape roll support 6, so that the separable paper sheet 4 is given adequate tension around the transfer member 10 while undergoing a slip between the feed roller 8 and the pinch roller 11.

Thus, the user transferring the adhesive (i.e., correcting tape in this embodiment) to the transfer surface, can watch the front end of the transfer member, through which the adhesive to be transferred to the transfer surface is led out, from above with the laid-down case 2. The adhesive thus can be transferred by accurately locating it at the position, at which the transfer is to be done. The separable paper sheet 4 after transfer of adhesive is out in its progress direction with respect to the user's fingers holding the case 2 of the adhesive transfer device 1. Although not shown, an adequate cutter member may be formed at the outlet 12 of the case 2 so that the separable paper sheet may be readily cut apart.

Figure 7:
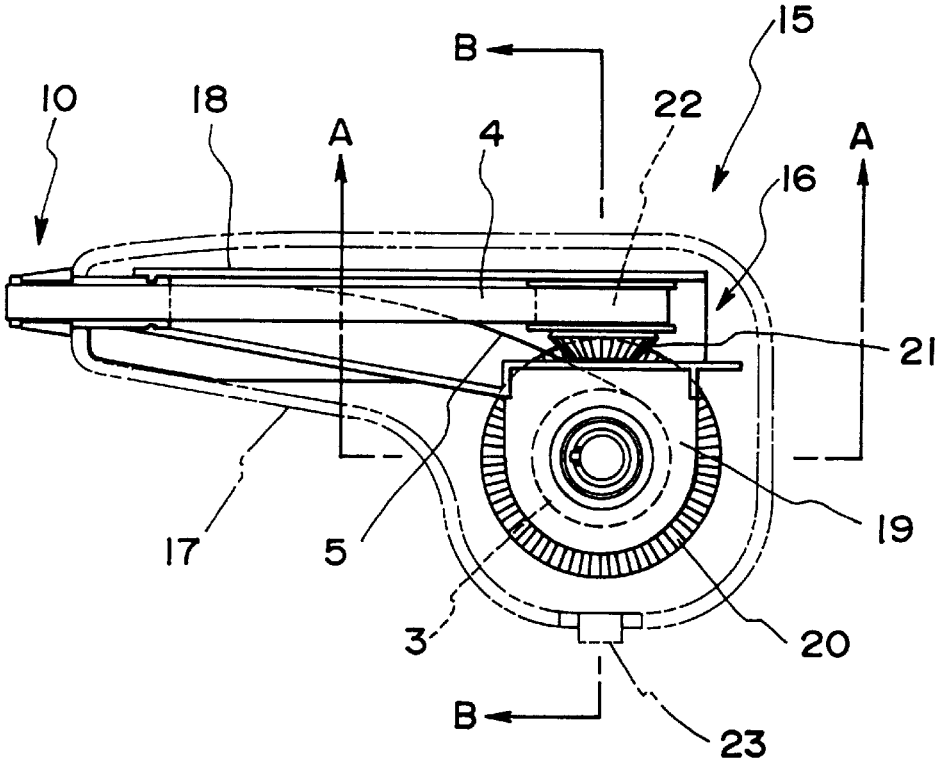
FIG. 7 is a plan view showing a second embodiment of the adhesive transfer device according to the present invention.
Figure 8:
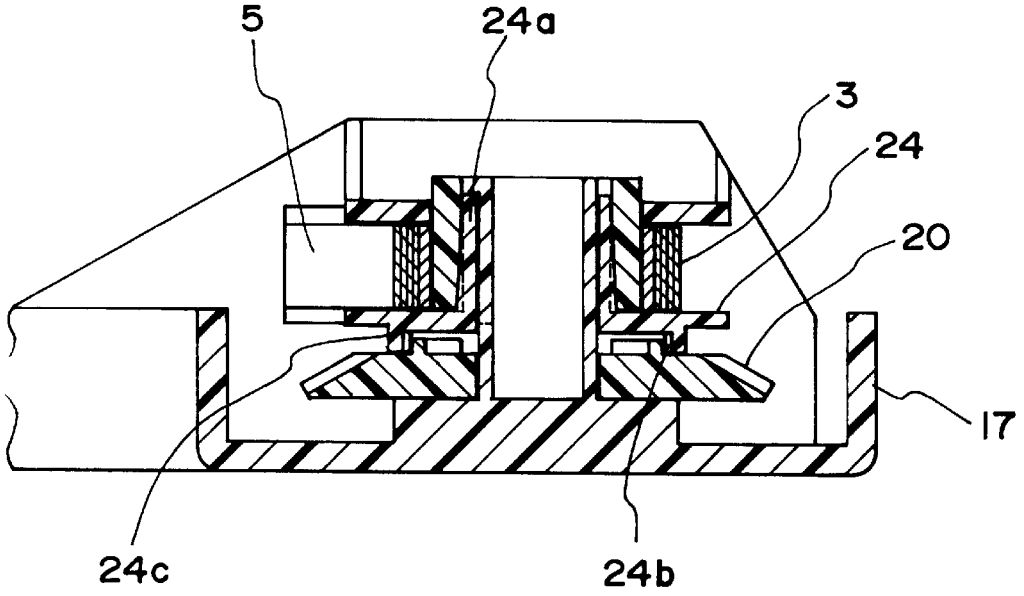
FIG. 8 is a sectional view taken along line A—A in FIG. 7.
Figure 9:
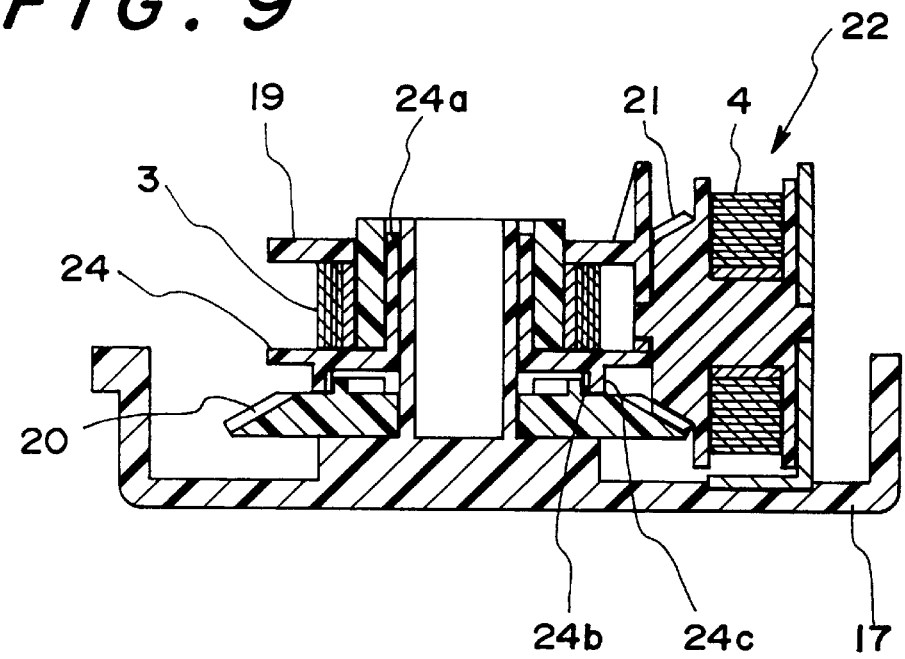
FIG. 9 is a sectional view taken along line B—B in FIG. 7.

FIGS. 7 to 9 show a second embodiment of the adhesive transfer device according to the present invention. This adhesive transfer device 15, unlike the preceding first embodiment, has a construction that the separable paper sheet left after the transfer of the adhesive is taken up into the case and that it can be used again by simply replacing the tape cassette with a replacement tape cassette 16 containing a tape roll, as shown in FIG. 10, instead of discarding it.

Figure 10:
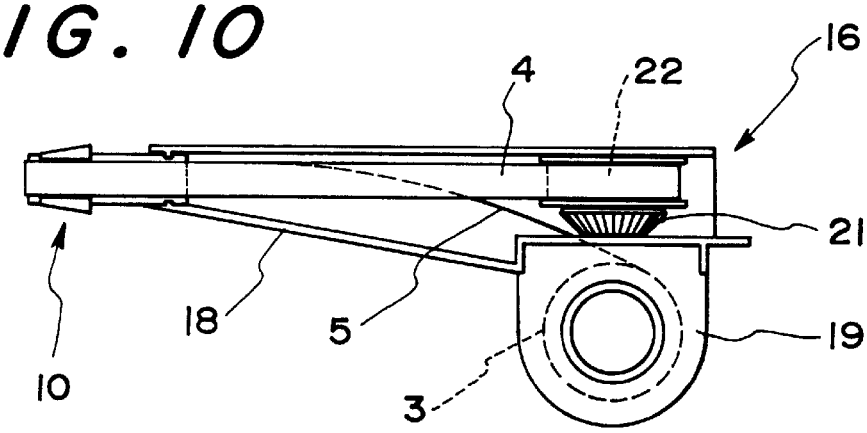
FIG. 10 is a plan view shoeing the second embodiment of the adhesive transfer device after taking out a cassette.
Figure 10:
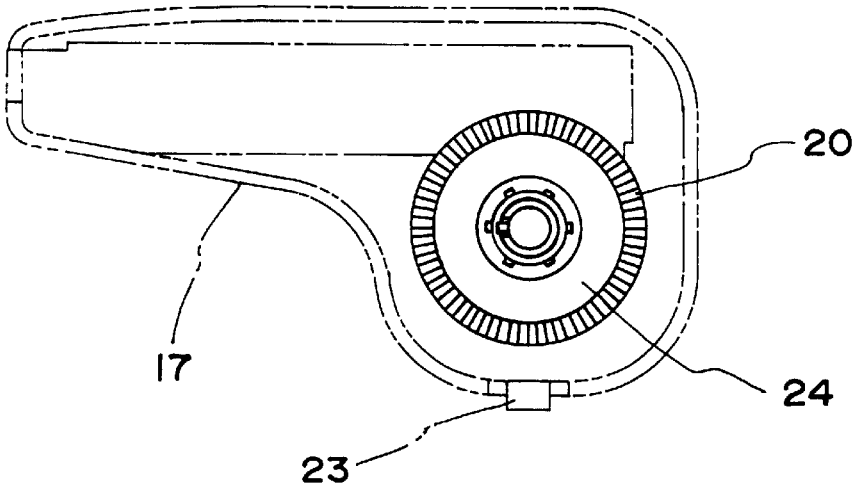

FIG. 10 shows the device with the replacement tape cassette 16 removed from the case 17. A frame member 18, which is a base of the replacement tape cassette 16 extends a flange 19 horizontally, which rotatably supports a tape roll 3. The adhesive transfer tape 5 paid off the tape roll 3 is guided to a transfer member 10 by changing the tape running direction by 90 degrees. The transfer member 10 has the same structure as in the first embodiment. The adhesive transfer tape 5 is led out of the case 17 with its adhesive surface as the outer surface, and the adhesive is transferred to the transfer surface of paper of the like by pulling the case 17 in the adhesive transfer direction with the adhesive surface held pushed against the transfer surface. The separable paper sheet 4 left after the transfer of adhesive, is taken up on a take-up roller 22 having a second bevel gear 21, which is meshed with a first bevel gear 20 with its axis at right angles to the axis of the first bevel gear 20.

The first bevel gear 20 is rotatably disposed in the case 17, which is hinged by a hinge 23, on the side of the case facing the transfer surface. The top of the first bevel gear 20 is engaged by a friction means 24. With the provision of the friction means 24, the first bevel gear 20 is rotated in unison with the tape roll 3 when the difference between the torque acting on the tape roll 3 and it is below a predetermined value, and it slips and idles when the torque difference exceeds the predetermined value.

Figure 11:
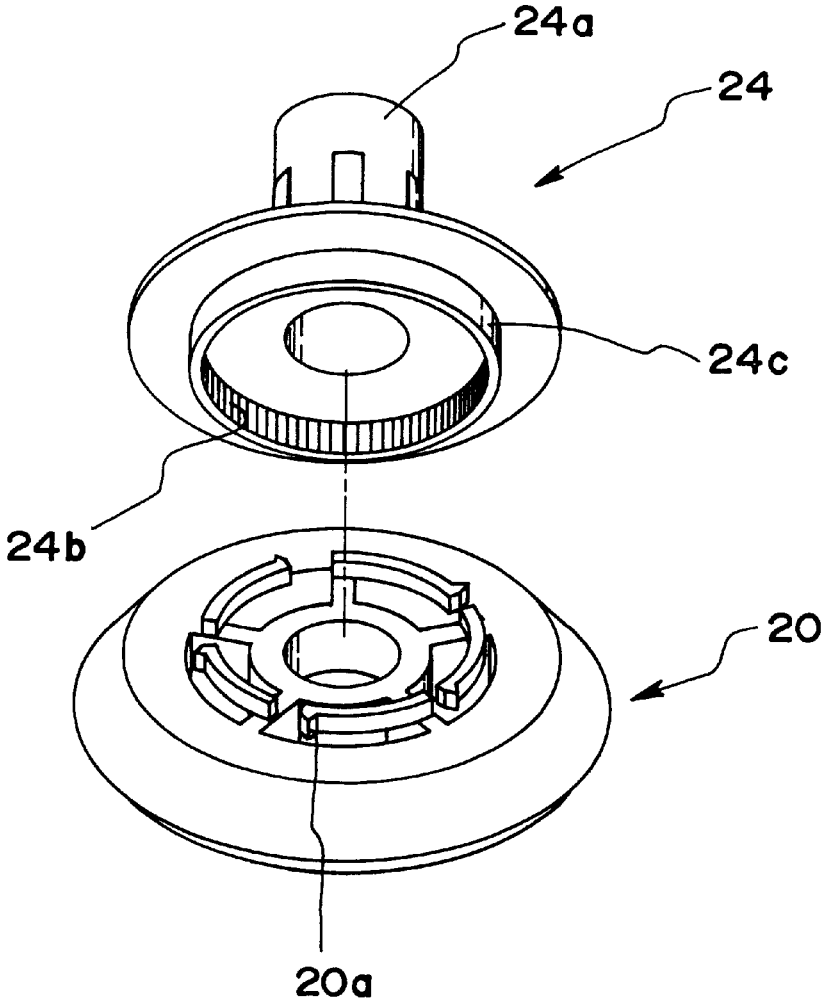
FIG. 11 is an exploded perspective view for describing friction means in the second embodiment of the adhesive transfer device.
Figure 12:
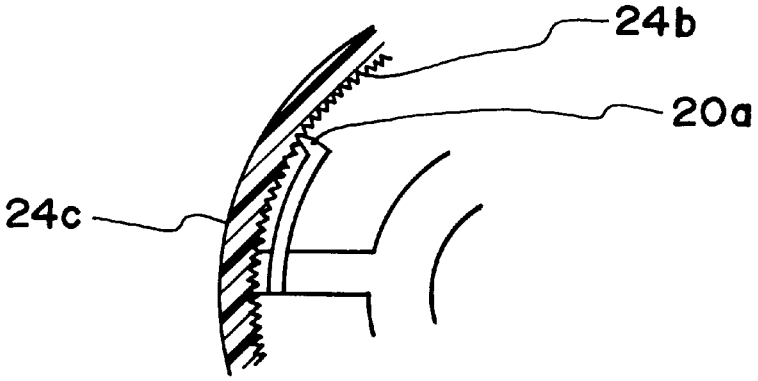
FIG. 12 is a fragmentary sectional view for describing the friction means in the second embodiment of the adhesive transfer device.

As shown in FIGS. 11 and 12, the friction means 24 has an engagement shaft 24*a* extending upward and having raised and recessed surfaces in engagement with raised and recessed surfaces of the inner periphery of the tape roll 3, and also has a cylinder 24*c* extending downward and having a gear 24*b* with fine teeth formed in the inner periphery. The first bevel gear 20 has its top surface provided with five circumferentially spaced-apart pawl members 20*a*. The pawl members 20*a* are formed on the tip of an arched spring member. The gear 24*b* and pawl members 20*a* mesh with one another, and form a friction means, which has a structure resembling a ratchet mechanism and can be relatively rotated in opposite directions. Of course it is possible to adopt a different structure of the friction means.

While the same length of the adhesive transfer tape 5 is paid off the tape roll 3 as the length of the separable paper sheet 4 taken up on the take-up roller 22, with the tooth number ratio between the first and second bevel gears 20 and 21 set to about 2:1 as in the first embodiment, the take-up roller 22 is rotated at double the speed of the tape roll 3 as in the first embodiment. The transfer of adhesive to the transfer surface causes the adhesive transfer tape 5 to be paid off, thus applying a torque to the tape roll 3. This torque is transmitted via the first and second bevel gears 20 and 21 to the take-up roller 22.

However, with the rotation of the take-up side (i.e., take-up roller 22) at a higher speed than on the pay-off side (i.e., tape roll 3), the tension exerted to the separable paper sheet 4 is gradually increased. This tension is transmitted via the take-up roller 22 and the second and first bevel gears 21 and 20 in the mentioned order, thus increasing the torque as the drive force for causing rotation of the first bevel gear 20. When this torque is excessively increased, it may be such as to cause reverse rotation of the tape roll 3, which the adhesive transfer tape 5 is being paid off from, thus eventually causing the separable paper sheet 4 to be broken apart. To evade this situation, in this embodiment with an increase of the torque applied to the first bevel gear 20, the pawl members 20*a* of the first bevel gear 20 are detached from the gear 24*b* of the friction means 24, thus causing the first bevel gear 20 to idle relative to the tape roll 3 and adjusting the tension.

In the actual operation, by continuously paying off the adhesive transfer tape 5 from the tape roll 3, the take-up roller 22 turns to repeatedly start and stop the take-up of the separable paper sheet at a high frequency while providing an adequate tension to a portion of the adhesive transfer tape 5 around the transfer member 10.

In each embodiment described above the adhesive transfer tape was described such that it used adhesive having low viscosity such as those used for correction tapes and marking tapes. However, adhesive having higher viscosity usually can be transferred more easily than adhesive having lower viscosity. Naturally, the adhesive transfer device according to the invention can be used not only low viscosity adhesive but also with high viscosity adhesive.

As has been described in the foregoing, in the adhesive transfer device according to the present invention, a first bevel gear is rotatably disposed in the case and coaxially engaged the tape roll, and a second bevel gear is in mesh with the first bevel gear such that the axes of the two gears are at right angles to each other, the second bevel gear having a smaller number of teeth than the number of the first bevel gear and being formed on one side of a roller disposed on the extension of the separable paper sheet left adhesive transfer of adhesive and returned from the transfer member into the case, the roller being capable of pulling the separable paper sheet left after the adhesive transfer. Thus, the user can transfer adhesive by watching the end portion of the transfer member from above with the case held in the laid-down state. Also, even when the adhesive is weakly adhesive and provides little frictional force such as correction tape and marking tape, the adhesive transfer tape and the separable paper sheet can be fed out smoothly. Furthermore, the device can be used repeatedly by replacing the roll tape instead of discarding it.

In addition, the separable paper sheet that is left after the adhesive transfer is pulled by the roller and a guide in contact with the roller surface and discharged to the outside of the case through an outlet provided in its extension behind a feed roller disposed in the case. The separable paper sheet thus can be discharged to the outside of the case without being collected in the case. Also, the device is relatively simple in construction and can be repeatedly used by replacing the tape roll.

Furthermore, the case further accommodates a take-up roller for pulling and taking up the separable paper sheet left after the adhesive transfer, and a friction means disposed between the tape roller and the first bevel gear coaxial and rotatable therewith and causing the first bevel gear to be rotated in unison with the tape roll when the torque supplied to the first bevel gear is below a predetermined level while causing the first bevel gear to slip and slide when the applied torque exceeds the predetermined level, thereby making up for the rotation of the take-up roller at a rotational speed higher than the rotational speed of the tape roller paying off the adhesive transfer tape to the teeth member difference between the first bevel gear and the second bevel gear having a smaller number of teeth than the first bevel gear. Thus, the adhesive transfer tape is given an adequate tension around the transfer member, and the separable paper sheet can be taken up reliably in the case without being broken apart.

Still further, the tape roll, the transfer member and the roller having the second bevel gear formed thereon are detachably mounted in the case. Thus, when the roll tape is used up, the device can be repeatedly used by doing a simple operation of merely replacing the cassette with a replacement one, which has the tape roll, the transfer member and the roller having the second bevel gear.

What is claimed is:

1. An adhesive transfer device comprising a case accommodating a tape roll rotatably disposed therein, the tape roll being one obtained by winding an adhesive transfer tape having a separable paper sheet and an adhesive applied thereto so as to be capable of being transferred, and a transfer member with an end portion projecting outward from the case for guiding the adhesive transfer tape paid out of the tape roll with the adhesive as the outer surface, the adhesive being transferred to a transfer surface by pulling the case in an adhesive transfer direction while the adhesive of a portion of the adhesive transfer tape located at the end portion of the transfer member is held pushed against the transfer surface, which adhesive tape transfer device further comprises:

a first bevel gear rotatably disposed in the case and coaxially engaging with the tape roll, and a second bevel gear meshing with the first bevel gear such that axes of the two gears are at right angles to each other, the second bevel gear having a smaller number of teeth than the first bevel gear and being formed on one side of a roller positioned to be disposed on an extension of the separable paper sheet left after transfer of adhesive and returned from the transfer member into the case, the roller being capable of pulling the separable paper sheet left after the adhesive transfer.

2. The adhesive transfer device according to claim 1, wherein said roller comprises a feed roller, and the separable paper sheet left after the adhesive transfer is pulled by the roller and a guide pressing against the feed roller and discharged to the outside of the case through an outlet of the case disposed behind said feed roller, wherein said feed is disposed in the case.

3. The adhesive transfer device according to claim 1, wherein the roller comprises a take-up roller for pulling and taking up the separable paper sheet left after the adhesive transfer, and a friction means disposed between the tape roll and the first bevel gear coaxial and rotatable therewith and causing the first bevel gear to be rotated in unison with the tape roll when a torque applied to the first bevel gear is below a predetermined level while causing the first bevel gear to slip and idle when the applied torque exceeds the predetermined level, thereby making up for rotation of the take-up roller at a rotational speed higher than a rotational speed of the tape roll paying off the adhesive transfer tape due to the second bevel gear having a smaller number of teeth than the first bevel gear.

4. The adhesive transfer device according to claim 1, wherein the tape roll is mounted such as to be parallel to side surfaces of the case, and the transfer member has a tape guide surface parallel to the side surfaces of the case, thereby permitting the end portion of the transfer member to be readily watched from above by laying down the case when transferring the adhesive.

5. The adhesive transfer device according to claim 1, wherein the tape roll, the transfer member and the roller are detachably mounted in the case.

* * * * *